US007460096B2

(12) United States Patent
Shin

(10) Patent No.: US 7,460,096 B2
(45) Date of Patent: Dec. 2, 2008

(54) DISPLAY PANEL, LIGHT EMITTING DISPLAY DEVICE USING THE SAME, AND DRIVING METHOD THEREOF

(75) Inventor: Dong-Yong Shin, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 621 days.

(21) Appl. No.: 10/971,188

(22) Filed: Oct. 22, 2004

(65) Prior Publication Data

US 2005/0116903 A1 Jun. 2, 2005

(30) Foreign Application Priority Data

Nov. 29, 2003 (KR) ..... 10-2003-0086127

(51) Int. Cl.
*G09G 3/32* (2006.01)

(52) U.S. Cl. ..... 345/83

(58) Field of Classification Search ..... 345/82–83, 345/76–77

See application file for complete search history.

(56) References Cited

U.S. PATENT DOCUMENTS 6,661,180 B2 * 12/2003 Koyama ..... 315/169.3
7,109,952 B2 * 9/2006 Kwon ..... 345/76
2006/0214891 A1 * 9/2006 Hanari et al. ..... 345/77

* cited by examiner

*Primary Examiner*—Amr Awad
*Assistant Examiner*—Randal Willis
(74) *Attorney, Agent, or Firm*—Christie, Parker & Hale, LLP

(57) ABSTRACT

A display panel of a light emitting display device includes a plurality of pixel circuits disposed in a matrix format. At least one of the pixel circuits includes a light emitting element, a transistor, a capacitor, a first switch, and a second switch. The transistor has first, second, and third electrodes and is for outputting a current corresponding to a voltage applied between the first and second electrodes to the third electrode. The light emitting element is for emitting light corresponding to the current outputted by the transistor. The capacitor is coupled between the first and second electrodes of the transistor. The first switch is for transmitting image signals to the first electrode of the transistor in response to a select signal, and the second switch is for electrically coupling the light emitting element to the third electrode of the transistor in response to an emit signal.

12 Claims, 6 Drawing Sheets

DISPLAY PANEL, LIGHT EMITTING DISPLAY DEVICE USING THE SAME, AND DRIVING METHOD THEREOF

CROSS REFERENCE TO RELATED APPLICATION

This application claims priority to and the benefit of Korea Patent Application No. 10-2003-0086127 filed on Nov. 29, 2003 in the Korean Intellectual Property Office, the entire content of which is incorporated herein by reference.

BACKGROUND OF THE INVENTION (a) Field of the Invention

The present invention relates to a display panel, a light emitting display device using the display panel, and a driving method thereof. More specifically, the present invention relates to an organic electroluminescent (EL) display panel, a light emitting display device using the display panel, and a driving method thereof.

(b) Description of the Related Art

In general, an organic EL display panel is a display device for electrically exciting fluorescent and organic compounds and emitting light. The organic EL display panel voltage- or current-programs (M×N) organic emission cells to represent images. An organic emission cell includes an anode (e.g., an ITO: indium tin oxide), an organic thin film, and a metallic cathode layer. The organic thin film includes an emission layer (EML), an electron transport layer (ETL), and a hole transport layer (HTL) for balancing electrons and holes to improve emission efficacy, and additionally includes an electron injection layer) (EIL) and a hole injection layer (HIL).

Methods for driving the organic emission cells are classified as a passive matrix method, and an active matrix method using thin film transistors (TFTs). The passive matrix method provides anodes and cathodes that cross (or cross over or are perpendicular to) each other, and selects a line to drive the organic emission cells, while the active matrix method provides TFTs that access respective ITO pixel electrodes and drive the line according to a voltage maintained by a capacitance of a capacitor accessed to a gate of a TFT. Further, depending on formats of signals applied to the capacitor for establishing the voltage, the active matrix method can be categorized as a voltage programming method and a current programming method.

FIG. 1 shows an equivalent circuit diagram for a pixel circuit of a conventional voltage programming method. As shown in the organic EL display of the conventional voltage programming method, a transistor M1 is coupled to an organic EL element (OLED) to supply the current for emission, and the current of the transistor M1 is controlled by a data voltage applied through a switching transistor M2. A capacitor C1 for maintaining the applied voltage for a predetermined time is coupled between a source and a gate of the transistor M1.

When the switching transistor M2 is turned on, the data voltage is applied to the gate of the transistor M1 to charge the capacitor C1 with the voltage $V_{GS}$ at the gate and the source of the transistor M1, a current $I_{OLED}$ flows though the transistor M1 in correspondence to the voltage $V_{GS}$, and the organic EL element OLED emits light in correspondence to the current $I_{OLED}$.

The current flowing through the OLED is given as Equation 1.

Equation 1

$$I_{OLED} = \frac{\beta}{2}(V_{GS} - V_{TH})^2 = \frac{\beta}{2}(V_{DD} - V_{DATA} - |V_{TH}|)^2$$

where $I_{OLED}$ is a current flowing through the OLED, $V_{GS}$ is a voltage between the gate and the source of the transistor M1, $V_{TH}$ is a threshold voltage of the transistor M1, $V_{DATA}$ is a data voltage, and β is a constant.

As given in Equation 1, the current corresponding to the data voltage is supplied to the OLED, and the OLED emits light corresponding to the supplied current. The applied data voltage has multiple-stage values within a predetermined range so as to represent gray scales.

The pixel circuit of the conventional voltage programming method has difficulties in obtaining high gray scales because of deviations of the threshold voltage $V_{TH}$ and the carrier mobility, the deviations being caused by non-uniformity of a manufacturing process. For example, in order to represent 8-bit (i.e., 256) gray scales in a case of driving thin film transistors by a voltage of 3V (volts), it is required to apply the voltage to the gate of the thin film transistor with an interval less than the voltage of 12 mV(=3 V/256), and if the deviation of the threshold voltage of the thin film transistor caused by the non-uniformity of the manufacturing process is 100 mV, it is difficult to represent high gray scales. Also, it becomes more difficult to represent high gray scales since the value of β in Equation 1 is differentiated because of the deviation of electron mobility.

The pixel circuit of the current programming method achieves uniform display characteristics when the driving transistor in each pixel has non-uniform voltage-current characteristics, providing that a current source for supplying the current to the pixel circuit is uniform throughout the whole panel.

However, the current flowing through the OLED is a fine (or small) current, and it accordingly needs a lot of time to charge a data line with the fine current. For example, it may require several milliseconds to charge the load of the data line with a fine data current of about several tens to several hundreds of nA assuming that the capacitance of the data line is about 30 pF. Thus, on considering a line charging time of several tens of μs , the conventional current programming method is insufficient.

Also, in the conventional current programming method, when the current flowing though the OLED is increased so as to reduce the time used for charging the data line, the total brightness of pixels is increased and image characteristics are degraded.

SUMMARY OF THE INVENTION

It is an aspect of the present invention to prevent worsening of image characteristics while quickly charging the data line.

It is another aspect of the present invention to improve the quality of the light emitting display device.

In one exemplary embodiment of the present invention, a display panel of a light emitting display device includes a plurality of pixel circuits disposed in a matrix format. At least one of the pixel circuits includes a light emitting element, a transistor, a capacitor, a first switch, and a second switch. The transistor has a first electrode, a second electrode, and a third electrode and is for outputting a current corresponding to a voltage applied between the first and second electrodes to the third electrode. The light emitting element is for emitting light in correspondence to an amount of the current outputted by the transistor. The capacitor is coupled between the first and second electrodes of the transistor. The first switch is for transmitting image signals to the first electrode of the transistor in response to an applied select signal, and the second switch is for electrically coupling the light emitting element and the third electrode of the transistor in response to an applied emit signal. The emit signal is applied to the at least one of the pixel circuits at least twice during a data frame period for writing the image signals on a screen.

The at least one of the pixel circuits may further comprise a third switch for diode-connecting the transistor in response to the select signal.

The second switch may comprise a P channel transistor, and the emit signal may repeat a low level and a high level at least twice.

Intervals for the emit signal to maintain the low level during the data frame period may substantially have the same length.

Intervals for the emit signal to maintain the low level and the high level during the data frame period may substantially have the same length.

In another exemplary embodiment of the present invention, a display panel of a light emitting display device includes a plurality of pixel circuits disposed in a matrix format. At least one of the pixel circuits includes a transistor, a light emitting element, a capacitor, and a switch. The transistor has a first electrode, a second electrode coupled to a first power source, and a third electrode, and is for outputting a current corresponding to a voltage applied between the first and second electrodes to the third electrode. The light emitting element, coupled between the third electrode of the transistor and a second power source, is for emitting light in correspondence to an amount of the current outputted by the transistor. The capacitor is coupled between the first electrode of the transistor and a third power source. The switch is for transmitting image signals to the first electrode of the transistor in response to an applied select signal. In the display panel, at least one of the first, second, and third power sources supplies a variable voltage.

In still another exemplary embodiment of the present invention, a method for driving a light emitting display device is provided. The display device includes a plurality of pixel circuits formed in a matrix format. At least one of the pixel circuits includes a transistor, a capacitor, and a light emitting element. The transistor has a first electrode and a second electrode, and the capacitor is coupled between the first and second electrodes. The transistor outputs a current corresponding to the voltage stored in the capacitor to a third electrode of the transistor. The light emitting element is for emitting light in correspondence to an amount of the current outputted by the transistor.

The method for driving includes a method for driving the pixel circuits during a data frame period during which a data signal is applied to the at least one of the pixel circuits and a subsequent data signal is applied. The method for driving the pixel circuits includes transmitting the data signal to the first electrode of the transistor during a first interval, to thus charge the capacitor; coupling the third electrode of the transistor and the light emitting element during a second interval via a first electrical connection; interrupting the first electrical connection between the third electrode of the transistor and the light emitting element during a third interval; coupling the third electrode of the transistor and the light emitting element during a fourth interval via second electrical connection; and interrupting the second electrical connection between the third electrode of the transistor and the light emitting element during a fifth interval.

In still another exemplary embodiment of the present invention, a method for driving a light emitting display device is provided. The display device includes a plurality of pixel circuits disposed in a matrix format. At least one of pixel circuits includes a transistor, a capacitor, and a light emitting diode. The transistor has a first electrode, a second electrode coupled to an emit signal line, and a third electrode, and is for outputting a current corresponding to a voltage applied between the first and second electrodes to the third electrode. The capacitor is coupled between the first electrode of the transistor and a first power source. The light emitting element, coupled between the third electrode of the transistor and a second power source, is for emitting light in correspondence to an amount of the current outputted by the transistor.

The method for driving includes a method for driving the pixel circuits during a data frame period during which a data signal is applied to the at least one of the pixel circuits and a subsequent data signal is applied. The method for driving the pixel circuits includes applying a third voltage to the emit signal line, transmitting the data signal to the first electrode of the transistor, and thus charging the capacitor; and applying the third voltage and the voltage of the second power source to the emit signal line alternately at least twice.

In still yet another exemplary embodiment of the present invention, a method for driving a light emitting display device is provided. The display device includes a plurality of pixel circuits formed in a matrix format. At least one of the pixel circuits includes a transistor, a capacitor, and a light emitting diode. The transistor has a first electrode and a second electrode, and the capacitor is coupled between the first and second electrodes. The transistor outputs a current corresponding to the voltage stored in the capacitor to a third electrode of the transistor; and a light emitting element, coupled to the third electrode of the transistor and an emit signal line, is for emitting light in correspondence to an amount of the current outputted by the transistor.

The method for driving includes a method for driving the pixel circuits during a data frame period during which a data signal is applied to the at least one of the pixel circuits and a subsequent data signal is applied. The method for driving the pixel circuits includes (a) applying a first voltage to the emit signal line, transmitting the data signal to the first electrode of the transistor, and thus charging the capacitor; and (b) applying the first voltage and the second voltage to the emit signal line alternately at least twice. The first voltage is less than the second voltage.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF THE EXEMPLARY EMBODIMENTS

Figure 1:
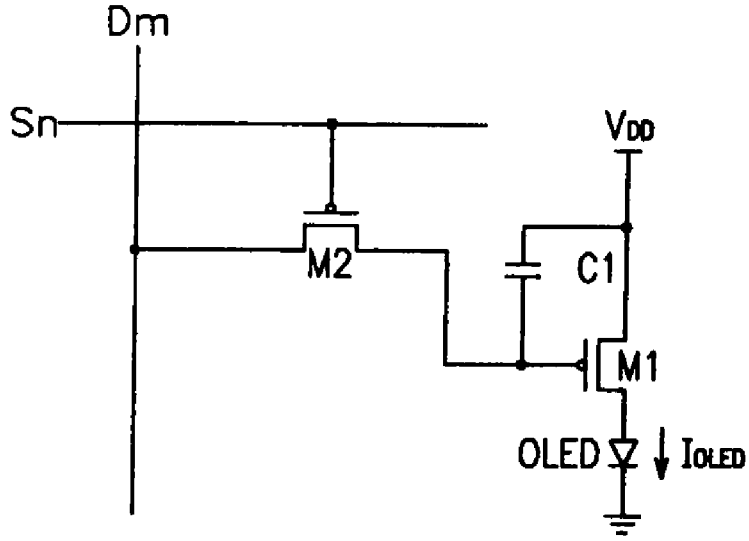
FIG.1 (PRIOR ART)
FIG. 1 shows an equivalent circuit diagram for a pixel circuit of the conventional voltage programming method.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive.

In the context of the present application, to couple one thing to another refers to directly coupling a first thing to a second thing or to couple a first thing to a second thing with a third thing provided therebetween. In addition, to clarify the present invention, certain components which are not described in the specification can be omitted, and like reference numerals indicate like components.

Figure 2:
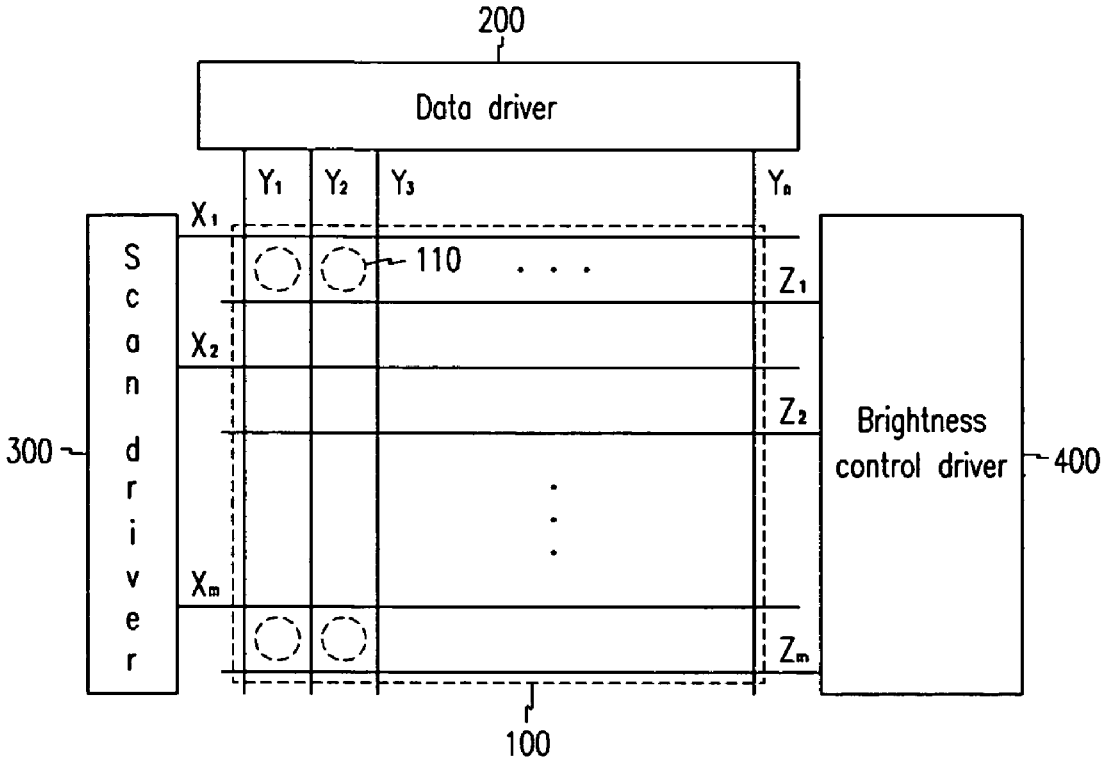
FIG. 2 shows a light emitting display device according to a first exemplary embodiment of the present invention.

FIG. 2 shows a light emitting display device according to a first exemplary embodiment of the present invention.

As shown, the light emitting display device includes an organic EL display panel 100 (referred to as a display panel hereinafter), a data driver 200, a scan driver 300, and a brightness control driver 400.

The display panel 100 includes a plurality of data lines $Y_1$ through $Y_n$ arranged in the column direction, a plurality of signal lines $X_1$ through $X_m$ and $Z_1$ through $Z_m$ arranged in the row direction, and a plurality of pixel circuits 110.

The signal lines include a plurality of select signal line $X_1$ through $X_m$ for transmitting a first scan signal, and a plurality of emit signal lines $Z_1$ through $Z_m$ for transmitting a second scan signal for controlling an emission period of an OLED. Pixel circuits 110 are formed at pixel regions defined by the data lines $Y_1$ through $Y_n$, and at the select and emit signal lines $X_1$ through $X_m$ and $Z_1$ through $Z_m$.

The data driver 200 applies the data current ($I_{DATA}$) to the data lines $Y_1$ through $Y_n$. The scan driver 300 sequentially applies the first scan signal for selecting pixel circuits to the select signal lines $X_1$ through $X_m$. The brightness control driver 400 sequentially applies the second scan signal for controlling the brightness of the pixel circuit 110 to the emit signal lines $Z_1$ through $Z_m$.

The scan driver 300 and the brightness control driver 400 and/or the data driver 200 are coupled to the display panel 100, or are installed in a chip configuration on a tape carrier package (TCP) adhered and coupled to the display panel 100. They can also be installed in a chip configuration on a flexible printed circuit (FPC) adhered and coupled to the display panel 100 or in a film adhered and coupled to the display panel 100. Differing from this, the scan driver 300 and the brightness control driver 400 and/or the data driver 200 can also be installed on a glass substrate. They can be substituted for a driving circuit having a layer identical with that of the signal lines, data lines, and thin film transistors on the glass substrate.

Figure 3:
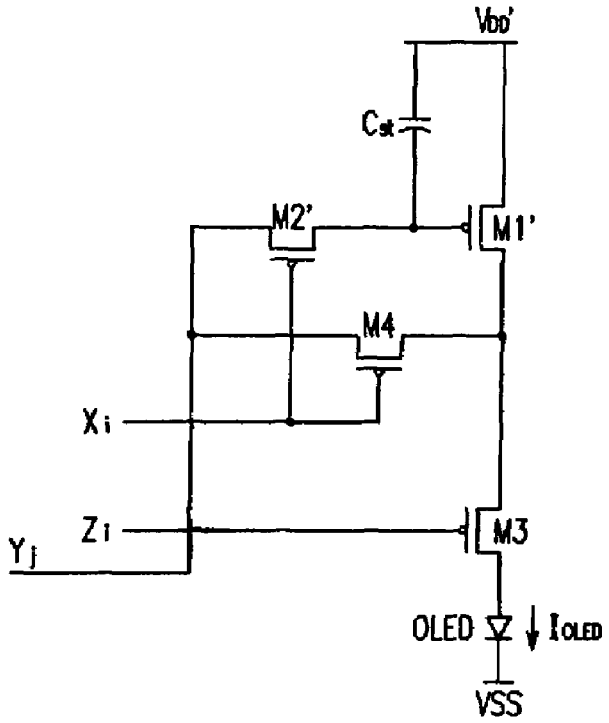
FIG. 3 shows a pixel circuit of a light emitting display device according to the first exemplary embodiment of the present invention.
Figure 4A:
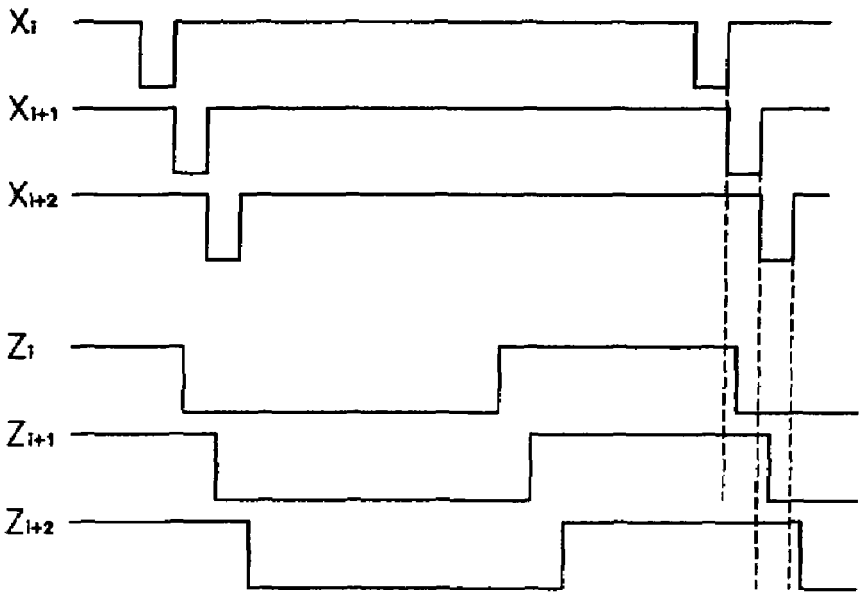
FIG. 4A shows a timing diagram of first and second scan signals respectively applied to a select signal line and an emit signal line according to the first exemplary embodiment of the present invention.
Figure 4B:
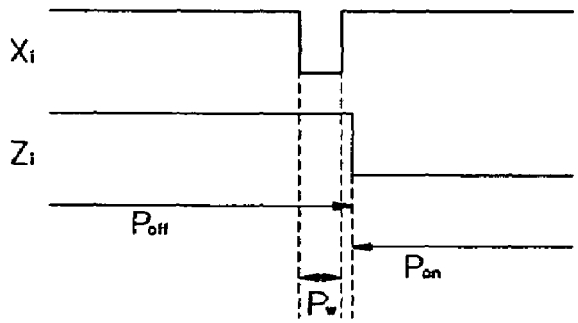
FIG. 4B shows a comparison timing diagram of the first and second scan signals of FIG. 4A.

FIG. 3 shows a pixel circuit (e.g., the pixel circuit 110) of a light emitting display device according to the first exemplary embodiment of the present invention, and FIGS. 4*a* and 4*b* show timing diagrams of first and second scan signals (e.g., respectively of lines $X_1$ through $X_m$ and lines $Z_1$ through $Z_m$) according to the first exemplary embodiment of the present invention. For ease of description, FIG. 3 shows a pixel circuit coupled to the $j^{th}$ data line $Y_j$ and the $i^{th}$ signal lines $X_i$ and $Z_i$.

As shown in FIG. 3, the pixel circuit 110 includes an organic EL element (OLED), transistors M1', M2', M3, and M4, and a capacitor Cst. PMOS transistors are used for the transistors M1', M2', M3, and M4, but the transistor types are not restricted to PMOS transistors. The transistors can be realized by active elements which include a first electrode, a second electrode, and a third electrode, respectively, and they output the current corresponding to the voltage applied to the first and second electrodes to the third electrode. Of course, those skilled in the art would recognize that the voltage polarities and levels may be different when other active elements are used.

The transistor M1' is coupled between a power source VDD' and the OLED, and it controls the current flowing to the OLED. In detail, a source of the transistor M1' is coupled to the power source VDD', and a drain thereof is coupled to an anode of the OLED through the transistor M3.

The transistor M2' transmits the data signal provided by the data line $Y_j$ to a gate of the transistor M1' in response to a first scan signal provided by the select signal line $X_i$. In detail, when the data signal is programmed to the pixel circuit, a second scan signal is maintained at a high level so that no current flows to the transistor M1', and the second scan signal is-maintained at a low level during the emission period so that the current of the transistor M1' is transmitted to the OLED.

The transistor M4 diode-connects the transistor M1' in response to the first scan signal (of signal line $X_i$).

The capacitor Cst is coupled between the gate and the source of the transistor M1', and it is charged with the voltage corresponding to the data current ($I_{DATA}$) provided by the data line $Y_j$.

The transistor M3 transmits the current flowing to the transistor M1' to the OLED in response to the second scan signal provided by the emit signal line $Z_i$.

Referring to FIGS. 4A and 4B, an operation of the pixel circuit shown in FIG. 3 will now be described.

FIG. 4A shows a timing diagram of first and second scan signals respectively applied to a select signal line (e.g., of $X_i$) and an emit signal line (e.g., $Z_i$) according to the first exemplary embodiment of the present invention, and FIG. 4B shows a compared timing diagram of the first and second scan signals.

As shown in FIG. 4A, the first scan signals for turning on the transistor M2' are sequentially applied to the select signal lines $X_i$, $X_{i+1}$, and $X_{i+2}$. When the transistor M2' is turned on, a voltage corresponding to the data current ($I_{DATA}$) from the data lines $Y_1$ through $Y_n$ is charged in the capacitor Cst. In this instance, the transistor M4 is also turned on because of the first scan signal (coupled to the gate of the transistor M4). In addition, because the transistor M4 is turned on, the transistor M1' is diode-connected, and accordingly, the capacitor Cst is charged with the voltage corresponding to the data current $I_{DATA}$ flowing through the transistor M1'. When the charging is complete (or finished), the transistors M2' and M4 are turned off, the transistor M3 is turned on according to the second scan signal applied from the emit signal lines $Z_i$, $Z_{i+1}$, and $Z_{i+2}$, and the data current ($I_{DATA}$) flows through the transistor M3.

In the above-described operation of the light emitting display device, levels of the second scan signals applied to the emit signal lines $Z_i$, $Z_{i+1}$, and $Z_{i+2}$ are sequentially changed as shown in FIG. 4A. When the second scan signals applied to the emit signal lines $Z_i$, $Z_{i+1}$, and $Z_{i+2}$ are low-level, the transistor M3 is turned on, the current applied from the transistor M1' is supplied to the OLED, and the OLED emits light corresponding to the current [Emission period (Pon)]. When the second scan signals applied to the emit signal lines $Z_i$, $Z_{i+1}$, and $Z_{i+2}$ are high-level, the transistor M3 is turned off, the current applied from the transistor M1 is not supplied to the OLED, and hence, the OLED emits no light [Non-emission period (Poff)].

In detail, as shown in FIG. 4B, the first scan signal (of $X_i$) for turning on the transistor M1' is applied during the non-emission period Poff to charge the voltage corresponding to the data current ($I_{DATA}$) from the data lines $Y_1$ through $Y_n$ in the capacitor Cst [Writing period (Pw)]. When the writing period is finished, and a predetermined time elapses, the level of the second scan signal applied to the emit signal line $Z_i$ becomes low level to start the emission period (Pon). When the emission is executed for a predetermined time, the level of the second scan signal becomes high level, no current is applied to the OLED, and the non-emission period Poff starts during which the OLED emits no light.

In the first exemplary embodiment, lengths of the emission period Pon and the non-emission period Poff are controlled according to a duty ratio of the second scan signal (of $Z_i$) supplied from the brightness control driver 400, and the brightness is accordingly controlled. Total brightness of the pixels is not increased, and the power consumption is not greatly increased because of duty driving when a high data current is used. Also, a current characteristic deviation of the transistor is lessened, and a stable operation of the light emitting display device is provided by using a high current area.

When the duty driving is performed as described in the first embodiment, a black screen is displayed between images of one frame and the next frame, and thereby the display panel flickers.

To solve the flickering problem, the driving method according to a second exemplary embodiment allows two or more emissions between one data programming and the next data programming to thus shorten the period for displaying the images on the pixels. As a result, a person perceives as if two images are consecutively displayed because of the after-image effect.

According to the second exemplary embodiment, the same image is emitted at least twice without programming new data since the data written during the writing period exists in the capacitor.

A data frame period represents a period for writing data on a screen, and an image frame period is referred to as a period for displaying a screen corresponding to the screen. In detail, the data frame period represents a period of time until the next data will be written after the data have been written on a pixel once, and the image frame period indicates a period until a pixel emits light after the pixel has emitted light according to the stored data.

Figure 5A:
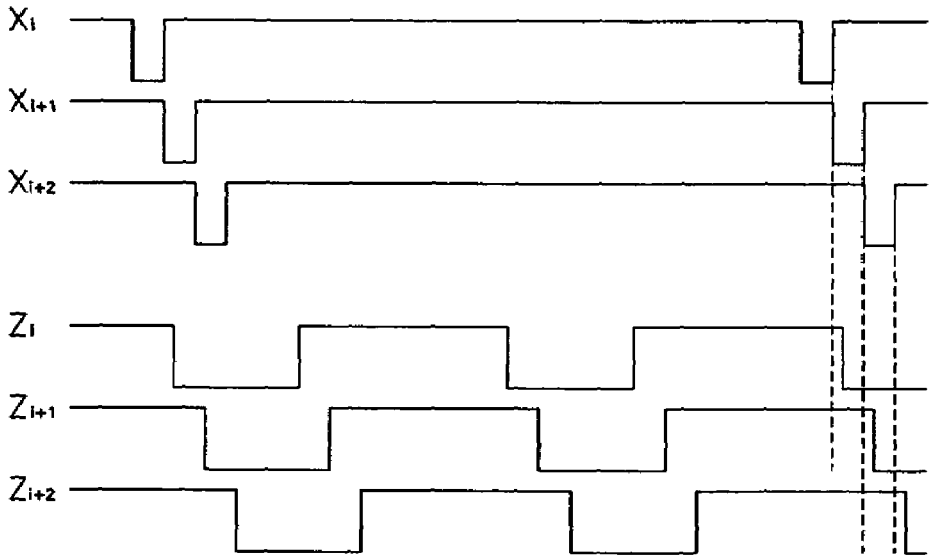
FIG. 5A shows a timing diagram of first and second scan signals applied to a select signal line and an emit signal line according to a second exemplary embodiment of the present invention.
Figure 5B:
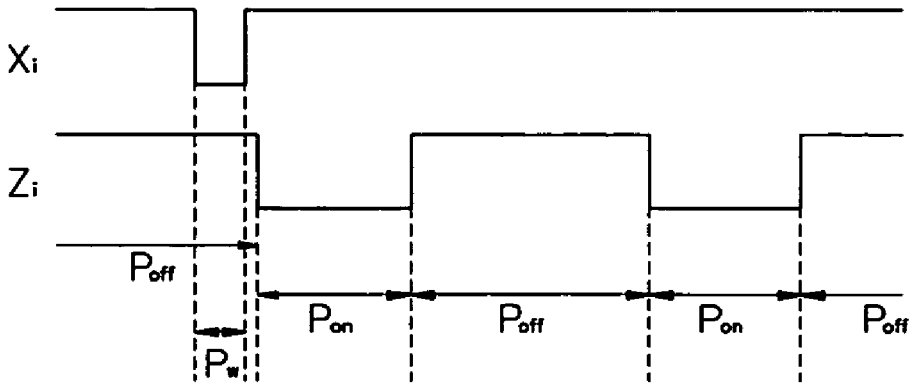
FIG. 5B shows a compared timing diagram of the first and second scan signals of FIG. 5A according to the second exemplary embodiment of the present invention.

Referring to FIGS. 5A and 5B, an operation of the light emitting display device according to the second exemplary embodiment will now be described.

FIG. 5A shows a timing diagram of first and second scan signals applied to a select signal line and an emit signal line according to the second exemplary embodiment of the present invention, and FIG. 5B shows a compared timing diagram of first and second scan signals according to the second exemplary embodiment of the present invention.

As shown in FIG. 5A and referring now also to FIG. 3, the first scan signal for turning on the transistor M2' is sequentially applied to the select signal lines $X_i$, $X_{i+1}$, and $X_{i+2}$. When the transistor M2' is turned on by the first scan signal, the voltage corresponding to the data current ($I_{DATA}$) provided by the data lines Y1 through Yn is charged in the capacitor Cst. In this instance, the transistor M4 is turned on by the first scan signal, and the transistor M1' is diode-connected. Therefore, the voltage corresponding to the data current ($I_{DATA}$) flowing through the transistor M1' is charged in the capacitor Cst. As a result, the voltage corresponding to the data current ($I_{DATA}$) is charged in the capacitor Cst, and is maintained, and the OLED repeatedly emits light according to the current corresponding to the voltage.

When the charging is finished, the transistors M2' and M4 are turned off, and the transistor M3 is turned on according to the second scan signal applied by the emit signal lines $Z_i$, $Z_{i+1}$, and $Z_{i+2}$ so that the data current ($I_{DATA}$) flows through the transistor M3.

As shown in FIG. 5A, levels of the second scan signal applied to the emit signal lines $Z_i$, $Z_{i+1}$, and $Z_{i+2}$ are sequentially changed when the light emitting display device is driven. In this instance, the control signal applied to the emit signal lines $Z_i$, $Z_{i+1}$, and $Z_{i+2}$ sequentially becomes low level, sequentially becomes high level again, sequentially becomes low level again, and sequentially becomes high level again.

When the second scan signals applied to the emit signal lines $Z_i$, $Z_{i+1}$, and $Z_{i+2}$ are low level, the transistor M3 is turned on, the current applied by the transistor M1' is supplied to the OLED, and the OLED emits light in correspondence to the current [Emission period (Pon)]. When the second scan signals applied to the emit signal lines $Z_i$, $Z_{i+1}$, and $Z_{i+2}$ are high level, the transistor M3 is turned off, the current applied by the transistor M1' is not supplied to the OLED, and hence, the OLED emits no light [Non-emission period (Poff)].

FIG. 5B shows a compared timing diagram of first and second scan signals according to the second exemplary embodiment of the present invention.

As shown in FIG. 5B, the first scan signal for turning on the transistor M1 is applied during the non-emission period Poff to charge the voltage corresponding to the data current ($I_{DATA}$) provided from the data lines $Y_1$ through $Y_n$ in the capacitor Cst [Writing period (Pw)].

When the writing period is finished, and a predetermined time elapses, the level of the second scan signal applied to the emit signal line $Z_i$ becomes low level to start the first emission period (Pon). When the emission is executed for a predetermined time, the level of the second scan signal becomes high-level, no current is applied to the OLED, and the non-emission period Poff starts during which the OLED emits no light.

The level of the second scan signal then becomes low level, and the second emission period Pon is started (again). The level of the second scan signal becomes high level after emission for a predetermined time to begin the non-emission period Poff (again).

According to the second exemplary embodiment, when the transistor M3 is added, and the second scan signal applied to the transistor M3 is controlled, the number of times of displaying the images becomes greater than the number of times of updating the data, and the image displayed between one frame and the next frame is consecutively displayed.

In the second exemplary embodiment, the images should be repeated at intervals of a predetermined time in order to minimize the period for displaying the black screen between one frame and the subsequent frame in the image frame period. That is, the length of the non-emission period should be maintained at a constant value because when the non-emission period is not constant, the length of the non-emission period becomes longer than in the case in which at least one period is constant.

Also, when the light emission is generated twice during the data frame period as described in the second exemplary embodiment, it is desirable for the lengths of the respective light emission periods to be half the emission period of FIGS. 4A and 4B of the first exemplary embodiment in order to display substantially the same brightness as that of the first exemplary embodiment. That is, it is desirable for the emission period to be 1/N times the first exemplary embodiment when the light emission is performed N times during the data frame period.

According to the driving method in the second exemplary embodiment, the frequency of the image frames can be established to be greater than 60 Hz while the frequency of the data frame is established to be less than 60 Hz, and hence, the time for writing the data is increased.

The method for controlling the second scan signal applied to the emit signal line $Z_i$ in order to generate two or more emissions during the data frame period in the second exemplary embodiment has been described in the present application for exemplary purposes only. In practice, other suitable methods for generating two or more emissions can also be used.

Figure 6:
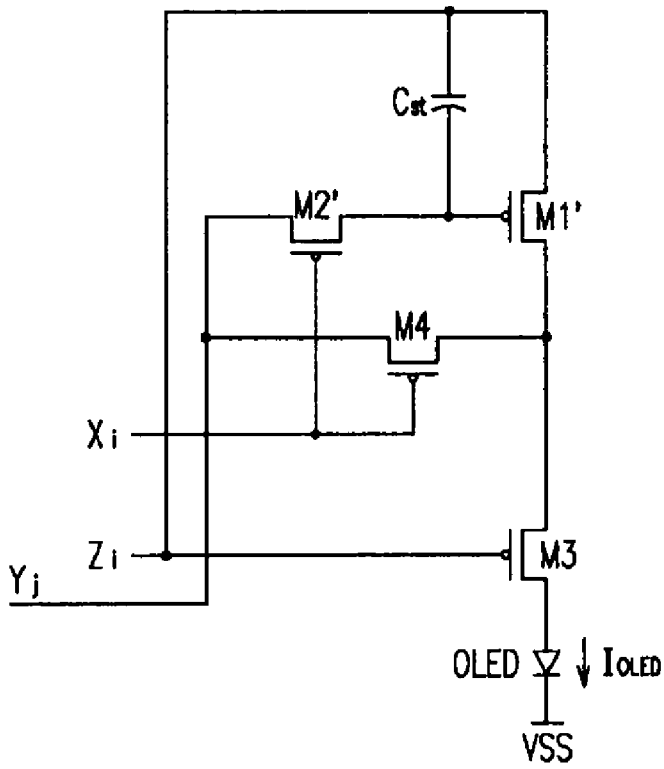
FIG. 6 shows a pixel circuit of a light emitting display device according to a third exemplary embodiment of the present invention.

For example, referring now to FIG. 6, the capacitor Cst can be switched. In this method, one electrode of the capacitor Cst is intercepted from the power source VDD' to couple an emit signal line to the capacitor Cst, and the voltage applied to the emit signal line $Z_j$ is controlled to thus allow two or more light emissions during the data frame period.

In detail, the power source VDD' is applied to the emit signal line to thus perform the same operation as that of the second exemplary embodiment during the writing period and the emission period. A voltage greater than the power source VDD' is applied to the emit signal line during the non-emission period. In this instance, no current path is formed at the other electrode of the capacitor Cst since the transistors M2' and M4 are turned off. Therefore, the voltage at the other electrode of the capacitor Cst is increased in correspondence to the rise of the voltage at one electrode thereof since the voltages at both electrodes of the capacitor Cst are maintained at constant values.

In this instance, since the gate of the transistor M1' is coupled to the other electrode of the capacitor Cst, when the voltage applied to the one electrode of the capacitor Cst is controlled so that the value obtained by subtracting the voltage of the power source VDD' applied to the source of the transistor M1' from the increased voltage at the capacitor Cst may be greater than the threshold value at the transistor M1', the transistor M1' is turned off, and no current flows to the OLED.

Light emission is generated at least twice during the data frame period by controlling the voltage applied to one electrode of the capacitor Cst.

It has been described that the voltage of the power source VDD' is applied to the emit signal line during the writing period and the emission period, and in addition, the voltage at one electrode of the capacitor Cst during the emission period can be established to correspond to the voltage during the writing period, and a predetermined voltage other than the voltage of the power source VDD' can be applied during the writing period and the emission period. The case of applying the voltage of the power source VDD' has an advantage of reducing the number of powers for supplying voltages.

Another method for generating light two or more emissions during the data frame period is to control the power source VDD' of the pixel circuit or the voltage of the power source VSS.

In detail, the emit signal line is coupled to the electrode of the power source VDD' and the voltage applied to the emit signal line is controlled in the case of controlling the power source VDD' of the pixel circuit. That is, the voltage of the power source VDD' is applied to the emit signal line during the writing period and the emission period, and the voltage of the power source VSS is applied thereto during the non-emission period.

Accordingly, the voltage at the electrode of the power source VDD' of the pixel circuit substantially corresponds to the voltage at the electrode of the power source VSS during the non-emission period, no current flows to the transistor M1', and hence, the OLED emits no light.

Further, the emit signal line is coupled to the electrode of the power source VSS and the voltage applied to the emit signal line is controlled in the case of controlling the power source VSS of the pixel circuit. That is, the voltage of the power source VSS is applied during the emission period, and the voltage of the power source VDD' is applied during the non-emission period. Either of the two voltages can be applied during the writing period.

Accordingly, the voltage at the electrode of the power source VDD' of the pixel circuit substantially corresponds to the voltage at the electrode of the power source VSS during the non-emission period, no current flows to the transistor M1', and hence, the OLED emits no light.

Many emission periods and non-emission periods can be formed during the data frame period by controlling voltage states of the power source VDD' and/or the power source VSS.

The method for performing duty driving by switching the emit signal line coupled to one electrode of the capacitor Cst or switching the emit signal line coupled to the electrode of the power source VDD' or the electrode of the power source VSS is applicable to the pixel circuit shown in FIG. 3, the pixel circuit shown in FIG. 1 and/or other suitable pixel circuits.

In addition, the ratio of times for turning on/off the light emitting elements at the time of duty driving can be set to be 1:1, and/or the times for turning them on/off can be controlled to other suitable ratios.

Moreover, it should be apparent to those skilled in the art that the time used for charging the data lines is effectively reduced in certain embodiments of the present invention. In particular, the time for charging the data lines is reduced without increasing the total brightness when the current $I_{OLED}$ flowing to the OLED is increased.

Further, the light emitting display region is stably driven by using a high current region with less current characteristic deviation of the driving transistor, and the image quality of the light emitting display device is improved since the images are consecutively displayed.

While this invention has been described in connection with certain exemplary embodiments, it is to be understood that the invention is not limited to the disclosed embodiments, but, on the contrary, is intended to cover various modifications included within the spirit and scope of the appended claims, and equivalents thereof.

What is claimed is:

1. A display panel of a light emitting display device comprising a plurality of pixel circuits disposed in a matrix format wherein at least one of the pixel circuits comprises:

a transistor having a first electrode, a second electrode coupled to a first power source, and a third electrode, the transistor for outputting a current corresponding to a voltage applied between the first and second electrodes to the third electrode;

a light emitting element, coupled between the third electrode of the transistor and a second power source, for emitting light in correspondence to an amount of the current outputted by the transistor;

a capacitor coupled between the first electrode of the transistor and a third power source; and a switch for transmitting image signals to the first electrode of the transistor in response to an applied select signal, wherein at least one of the first, second, and third power sources provides a variable voltage to allow the light emitting element to emit light at least twice during a data frame period, wherein the data frame period is from after an image signal of the image signals is applied to the at least one of the pixel circuits to before a subsequent image signal of the image signals is applied to the at least one of the pixel circuits, and wherein the second power source alternately provides a voltage which is less than the voltage of the first power source and the voltage of the first power source at least twice during the data frame period.

2. The display panel of claim 1, further comprising another switch, coupled between the third electrode of the transistor and the light emitting element, for interrupting an electrical connection between the third electrode of the transistor and the light emitting element.

3. The display panel of claim 1, further comprising another switch for diode-connecting the transistor in response to the select signal.

4. A display panel of a light emitting display device comprising a plurality of pixel circuits disposed in a matrix format wherein at least one of the pixel circuits comprises:

a transistor having a first electrode, a second electrode coupled to a first power source, and a third electrode, the transistor for outputting a current corresponding to a voltage applied between the first and second electrodes to the third electrode;

a light emitting element, coupled between the third electrode of the transistor and a second power source, for emitting light in correspondence to an amount of the current outputted by the transistor;

a capacitor coupled between the first electrode of the transistor and a third power source; and a switch for transmitting image signals to the first electrode of the transistor in response to an applied select signal, wherein at least one of the first, second, and third power sources provides a variable voltage to allow the light emitting element to emit light at least twice during a data frame period, wherein the data frame period is from after an image signal of the image signals are applied to the at least one of the pixel circuits to before a subsequent image signal of the image signals is applied to the at least one of the pixel circuits, and wherein at least twice during the data frame period, the third power source provides the voltage of the first power source and a voltage which is less than the voltage of the first power source by a first voltage alternately.

5. The display panel of claim 4, further comprising another switch, coupled between the third electrode of the transistor and the light emitting element, for interrupting an electrical connection between the third electrode of the transistor and the light emitting element.

6. The display panel of claim 4, further comprising another switch for diode-connecting the transistor in response to the select signal.

7. The display panel of claim 4, wherein an absolute value of a value obtained by subtracting the voltage of the first power source from a summation of the first voltage and the voltage applied to the first electrode of the transistor is less than an absolute value of the threshold value of the transistor.

8. A display panel of a light emitting display device comprising a plurality of pixel circuits disposed in a matrix format wherein at least one of the pixel circuits comprises:

a transistor having a first electrode, a second electrode coupled to a first power source, and a third electrode, the transistor for outputting a current corresponding to a voltage applied between the first and second electrodes to the third electrode;

a light emitting element, coupled between the third electrode of the transistor and a second power source, for emitting light in correspondence to an amount of the current outputted by the transistor;

a capacitor coupled between the first electrode of the transistor and a third power source; and a switch for transmitting image signals to the first electrode of the transistor in response to an applied select signal, wherein at least one of the first, second, and third power sources provides a variable voltage to allow the light emitting element to emit light at least twice during a data frame period, wherein the data frame period is from after an image signal of the image signals are applied to the at least one of the pixel circuits to before a subsequent image signal of the image signals is applied to the at least one of the pixel circuits, and wherein the third power source provides a voltage which substantially corresponds to the voltage of the first power source while the voltage of the second power source is varied.

9. The display panel of claim 8, further comprising another switch, coupled between the third electrode of the transistor and the light emitting element, for interrupting an electrical connection between the third electrode of the transistor and the light emitting element.

10. The display panel of claim 8, further comprising another switch for diode-connecting the transistor in response to the select signal.

11. A method for driving a light emitting display device comprising a plurality of pixel circuits disposed in a matrix format wherein at least one of the pixel circuits comprises:

a transistor having a first electrode, a second electrode coupled to a first power source, and a third electrode, the transistor for outputting a current corresponding to a voltage applied between the first and second electrodes to the third electrode;

a capacitor coupled between the first electrode of the transistor and an emit signal line; and a light emitting element, coupled between the third electrode of the transistor and a second power source, for emitting light in correspondence to an amount of the current outputted by the transistor, wherein the method for driving comprises a method for driving the pixel circuits during a data frame period being from after a data signal is applied to the at least one of the pixel circuits to before a subsequent data signal is applied to the at least one of the pixel circuits, the method for driving the pixel circuits comprises applying a third voltage to the emit signal line, transmitting the data signal to the first electrode of the transistor, and thus charging the capacitor, and applying the third voltage and a fourth voltage to the emit signal line alternately at least twice, wherein the third voltage has a voltage level that is substantially the same as that of the voltage of the first power source.

12. A method for driving a light emitting display device comprising a plurality of pixel circuits disposed in a matrix format wherein at least one of the pixel circuits comprises:

a transistor having a first electrode, a second electrode coupled to a first power source, and a third electrode, the transistor for outputting a current corresponding to a voltage applied between the first and second electrodes to the third electrode;

a capacitor coupled between the first electrode of the transistor and an emit signal line; and a light emitting element, coupled between the third electrode of the transistor and a second power source, for emitting light in correspondence to an amount of the current outputted by the transistor, wherein the method for driving comprises a method for driving the pixel circuits during a data frame period being from after a data signal is applied to the at least one of the pixel circuits to before a subsequent data signal is applied to the at least one of the pixel circuits, the method for driving the pixel circuits comprises applying a third voltage to the emit signal line, transmitting the data signal to the first electrode of the transistor, and thus charging the capacitor, and applying the third voltage and a fourth voltage to the emit signal line alternately at least twice, wherein the transistor comprises a P channel transistor, the first electrode is a gate, the second electrode is a source, and the third electrode is a drain, and wherein the fourth voltage is established to have a level which is greater than that of the third voltage so as to electrically interrupt the transistor while the second voltage is applied to the emit signal line.

* * * * *

UNITED STATES PATENT AND TRADEMARK OFFICE

CERTIFICATE OF CORRECTION

PATENT NO. : 7,460,096 B2
APPLICATION NO. : 10/971188
DATED : December 2, 2008
INVENTOR(S) : Dong-Yong Shin It is certified that error appears in the above-identified patent and that said Letters Patent is hereby corrected as shown below:

In the Claims

Column 11, line 60, Claim 4 Delete "are",
Insert --is--

Column 12, line 35, Claim 8 Delete "are",
Insert --is--

Signed and Sealed this

Second Day of June, 2009

John Doll

JOHN DOLL
*Acting Director of the United States Patent and Trademark Office*